US009739185B2

(12) United States Patent
Kuroda

(10) Patent No.: US 9,739,185 B2
(45) Date of Patent: Aug. 22, 2017

(54) LUBRICATING DEVICE FOR INTERNAL COMBUSTION ENGINE

(71) Applicant: DENSO CORPORATION, Kariya, Aichi-pref. (JP)

(72) Inventor: Akihiro Kuroda, Kariya (JP)

(73) Assignee: DENSO CORPORATION, Kariya (JP)

( * ) Notice: Subject to any disclaimer, the term of this patent is extended or adjusted under 35 U.S.C. 154(b) by 94 days.

(21) Appl. No.: 15/002,833

(22) Filed: Jan. 21, 2016

(65) Prior Publication Data

US 2016/0215663 A1 Jul. 28, 2016

(30) Foreign Application Priority Data

Jan. 22, 2015 (JP) ..... 2015-10000

(51) Int. Cl.

| | |
|---|---|
| ***F01M 1/06*** | (2006.01) |
| ***F01M 1/02*** | (2006.01) |
| ***F01M 9/10*** | (2006.01) |
| ***F02M 59/00*** | (2006.01) |

(52) U.S. Cl.

CPC ..... *F01M 1/02* (2013.01); *F01M 9/101* (2013.01); *F01M 9/104* (2013.01); *F02M 59/00* (2013.01); *F01M 2001/0261* (2013.01)

(58) Field of Classification Search

CPC ..... F01M 1/02; F01M 9/104; F01M 9/101; F01M 2001/0261; F02M 59/00

See application file for complete search history.

(56) References Cited

U.S. PATENT DOCUMENTS

2012/0199103 A1* 8/2012 Hashida ..... F02M 59/102 123/508

FOREIGN PATENT DOCUMENTS

JP 2008-286124 11/2008

* cited by examiner

*Primary Examiner* — Zelalem Eshete
(74) *Attorney, Agent, or Firm* — Nixon & Vanderhye PC

(57) ABSTRACT

A supply pump includes a housing that has a tappet receiving chamber, which receives a plunger drive mechanism, and oil for lubricating respective lubricating portions of the plunger drive mechanism is temporarily retained in the tappet receiving chamber. In the housing, a communication hole opens in an inner peripheral wall surface of a tappet guide and guides the oil from a tappet upper side chamber into a tappet lower side chamber at the time of upwardly moving a tappet.

7 Claims, 5 Drawing Sheets

LUBRICATING DEVICE FOR INTERNAL COMBUSTION ENGINE

CROSS REFERENCE TO RELATED APPLICATION

This application is based on and incorporates herein by reference Japanese Patent Application No. 2015-10000 filed on Jan. 22, 2015.

TECHNICAL FIELD

The present disclosure relates to a lubricating device for an internal combustion engine.

BACKGROUND

A tappet lubricating device has been previously proposed as a lubricating device of an internal combustion engine, which has a housing that includes a receiving chamber where oil for lubricating respective lubricating portions of a drive mechanism is retained. In the tappet lubricating device, oil for lubricating respective lubricating portions of a plunger drive mechanism is retained in a tappet receiving chamber of a housing of a supply pump installed to an internal combustion engine.

Here, the plunger drive mechanism is a converting mechanism that converts rotation of a cam of a camshaft into reciprocation of a plunger and includes a tappet (used as a lifter), a roller of the tappet, and a roller pin (a rotational shaft of the roller) (see, for example, JP2008-286124A).

FIG. 5 indicates a structure of a typical plunger pump that is used as a supply pump having the above described plunger drive mechanism.

The supply pump is constructed to pressurize and pump fuel, which is drawn into a pressurizing chamber 105 through a fuel suction valve 104, when a plunger 103 is reciprocated in a cylinder 102 along a contour of a cam 101 of a camshaft.

In the plunger drive mechanism, when the cam 101 is rotated through rotation of the camshaft, a roller pin 107 and a tappet 108 are reciprocated through a roller 106 in a top-to-bottom direction in the drawing. The upward and downward movement of the tappet 108 described above is transmitted to the plunger 103, so that the plunger 103 is reciprocated in the top-to-bottom direction of the drawing in the cylinder 102.

In the supply pump, slide movement occurs at a contact portion between the plunger and the tappet. Therefore, in order to limit wearing and seizing at the contact portion between the plunger and the tappet, oil is circulated and supplied in a tappet receiving chamber of the plunger drive mechanism.

For example, the oil is supplied to the contact portion between the plunger 103 and the tappet 108, so that an oil film is formed between the plunger 103 and the tappet 108 to lubricate the contact portion between the plunger 103 and the tappet 108.

The oil is also supplied to a contact portion between the cam 101 and the roller 106, a contact portion between the roller pin 107 and the tappet 108, and a roller bush placed between the roller 106 and the tappet 108.

Furthermore, a seal member 110 is installed in the supply pump to seal between the pressurizing chamber 105, which is formed at one axial end of the cylinder 102, and a tappet upper side chamber 109 of a tappet receiving chamber.

In the supply pump, as shown in FIG. 5, when the roller 106 is raised along the cam 101, the tappet 108 is moved upward along with the plunger 103. When the tappet 108 is moved upward, a volume of the tappet upper side chamber 109 of the tappet receiving chamber, which is located on the plunger side of the tappet 108, is reduced. In this way, the oil, which is retained in the tappet upper side chamber 109, is compressed, so that a pressure in the tappet upper side chamber 109 is increased.

Therefore, the seal member 110, which liquid-tightly seals between the tappet upper side chamber 109 and the pressurizing chamber 105 through a clearance, may be damaged, or a roller contact surface 111 of the cam 101 may be damaged. Thus, there will be a disadvantage, such as deterioration in a sealing performance of the seal member 110 or wearing of the roller contact surface 111 of the cam 101.

In order to avoid the above disadvantage, a pressure release passage, which releases a pressure (an oil pressure) in the tappet upper side chamber 109, is required. However, in many cases, a sufficient flow passage cross-sectional area of the pressure release passage cannot be ensured due to interference between the pressure release passage and another component or a fuel flow passage.

In view of the above disadvantage, JP2008-286124A discloses a supply pump that has a communication oil passage, which communicates between the tappet upper side chamber and a cam/shaft receiving chamber and is formed in a tappet guide of a housing as a pressure release passage for releasing the pressure in the tappet upper side chamber.

In this case, the communication oil passage, which is communicated with the tappet upper side chamber, opens in a bottom surface, which is different from a tappet slide surface of the tappet guide, to form a large space of the cam/shaft receiving chamber. In this way, the amount of change in the volume of the cam/shaft receiving chamber relative to the amount of change in the volume of the tappet upper side chamber becomes very small. Thereby, the pressure of the tappet upper side chamber cannot be easily decreased, so that oil suctioning effect for suctioning the oil from the tappet upper side chamber into the cam/shaft receiving chamber is small.

Thus, in the supply pump of JP2008-286124A, the oil suctioning effect, which is exerted by the upward movement of the tappet, cannot be expected too much, and the pressure increase of the tappet upper side chamber cannot be sufficiently limited.

SUMMARY

The present disclosure addresses the above disadvantage.

According to the present disclosure, there is provided a lubricating device for an internal combustion engine, including a camshaft, a high pressure fuel pump, and a housing. The camshaft includes a cam and is rotatable synchronously with an output shaft of the internal combustion engine. The high pressure fuel pump includes a plunger and a drive mechanism. The plunger is reciprocatable along a contour of the cam. The drive mechanism converts rotation of the cam into reciprocation of the plunger to reciprocate the plunger. The high pressure fuel pump pressurizes the fuel drawn through the reciprocation of the plunger. The housing includes a receiving chamber, which receives the drive mechanism. Oil is retained in the receiving chamber. The drive mechanism includes a roller, which contacts the cam, and a tappet, which is integrally movably connected to the roller and reciprocates integrally with the plunger. The tappet includes a partition portion, which partitions the receiving chamber into a plunger side chamber and a cam side chamber. The housing includes a guide, which is configured into a tubular form and guides the tappet in a reciprocating direction of the tappet, and a communication hole, which communicates between the plunger side chamber and the cam side chamber. The cam side chamber is a first volume variable chamber that is formed by a roller contact surface of the cam, an inner peripheral surface of the guide, and a cam side surface of the tappet.

According to the present disclosure, there is also provided a lubricating device for an internal combustion engine, including a camshaft, a high pressure fuel pump, a valve device, and a housing. The camshaft includes a first cam and a second cam and is rotated synchronously with an output shaft of the internal combustion engine. The high pressure fuel pump includes a plunger and a first drive mechanism. The plunger is reciprocatable along a contour of the first cam. The first drive mechanism converts rotation of the first cam into reciprocation of the plunger to reciprocate the plunger. The high pressure fuel pump pressurizes the fuel drawn through the reciprocation of the plunger. The valve device includes a valve and a second drive mechanism. The valve is reciprocatable along a contour of the second cam. The second drive mechanism converts rotation of the second cam into reciprocation of the valve to reciprocate the valve. The valve device opens and closes a port opening of the internal combustion engine. The housing includes a first receiving chamber, which receives the first drive mechanism, and a second receiving chamber, which receives the second drive mechanism. Oil is retained in the first receiving chamber and the second receiving chamber. The first drive mechanism includes a first roller, which contacts the first cam, and a first tappet, which is integrally movably connected to the first roller and reciprocates integrally with the plunger. The second drive mechanism includes a second roller, which contacts the second cam, and a second tappet, which is integrally movably connected to the second roller and reciprocates integrally with the valve. The first tappet includes a first partition portion, which partitions the first receiving chamber into a plunger side chamber and a first cam side chamber. The second tappet includes a second partition portion, which partitions the second receiving chamber into a valve side chamber and a second cam side chamber. The housing includes a communication hole, which communicates the plunger side chamber with the valve side chamber or the second cam side chamber.

BRIEF DESCRIPTION OF THE DRAWINGS

The drawings described herein are for illustration purposes only and are not intended to limit the scope of the present disclosure in any way.

DETAILED DESCRIPTION

Embodiments of the present disclosure will be described with reference to the accompanying drawings.

First Embodiment

Figure 1:
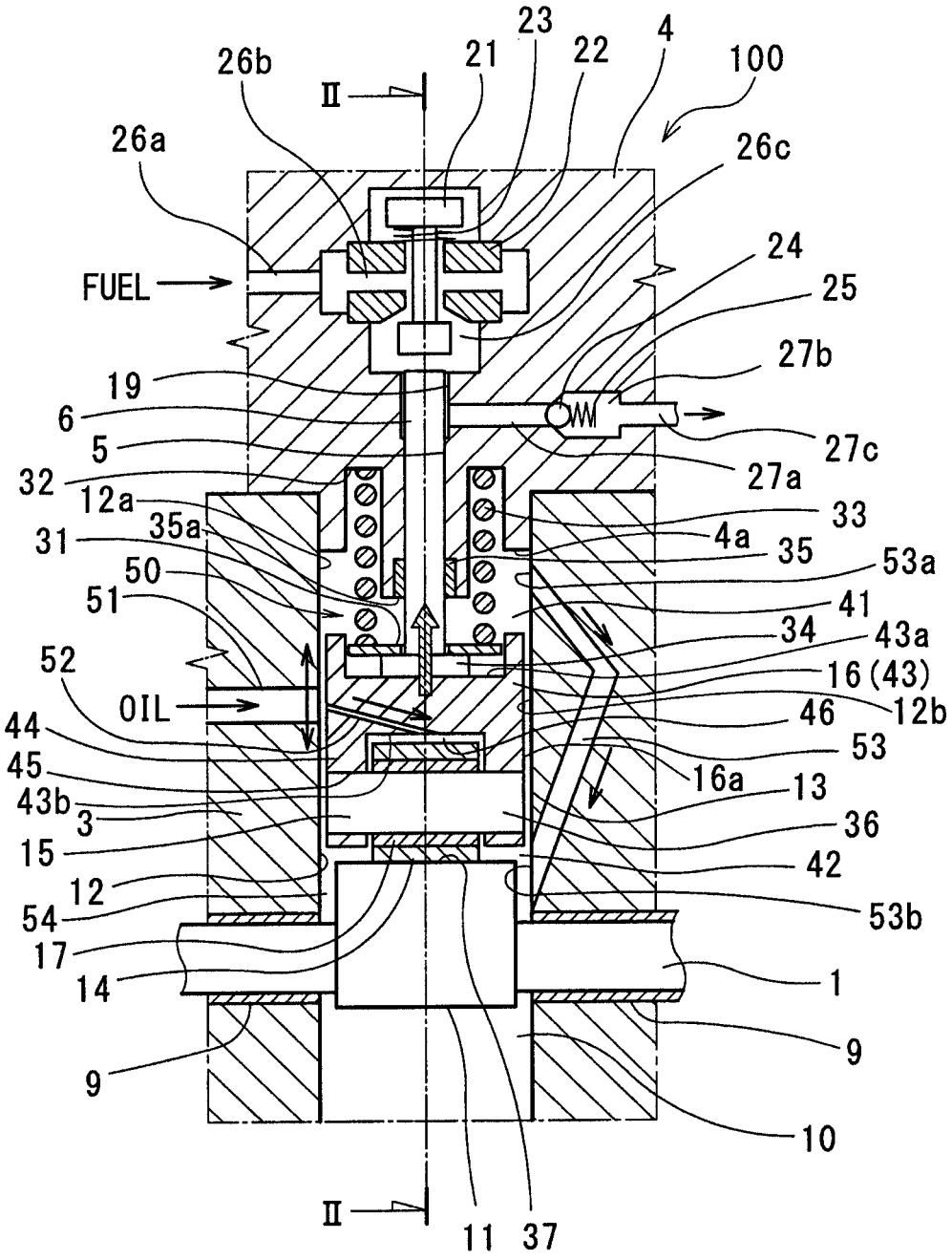
FIG. 1 is a cross-sectional view showing a schematic structure of an engine having a supply pump according to a first embodiment of the present disclosure.
Figure 2:
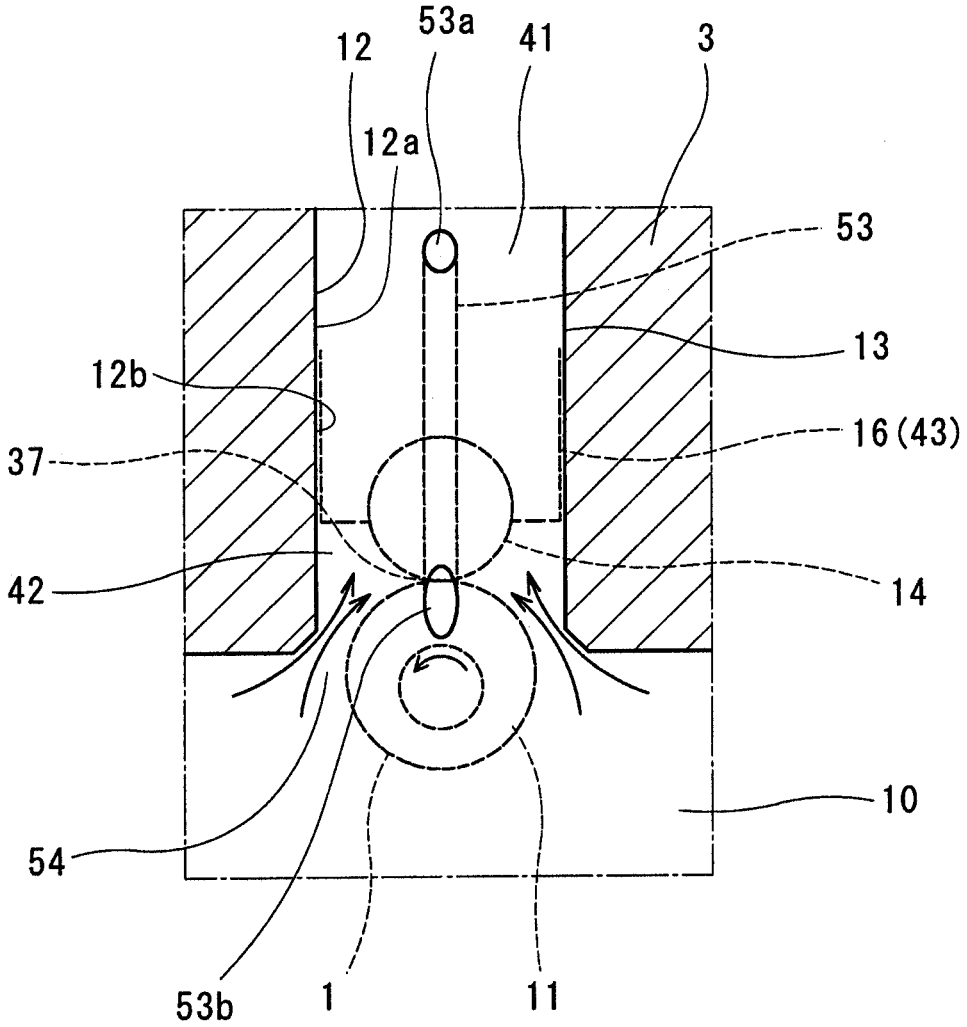
FIG. 2 is a cross-sectional view taken along line II-II in FIG. 1.
Figure 3:
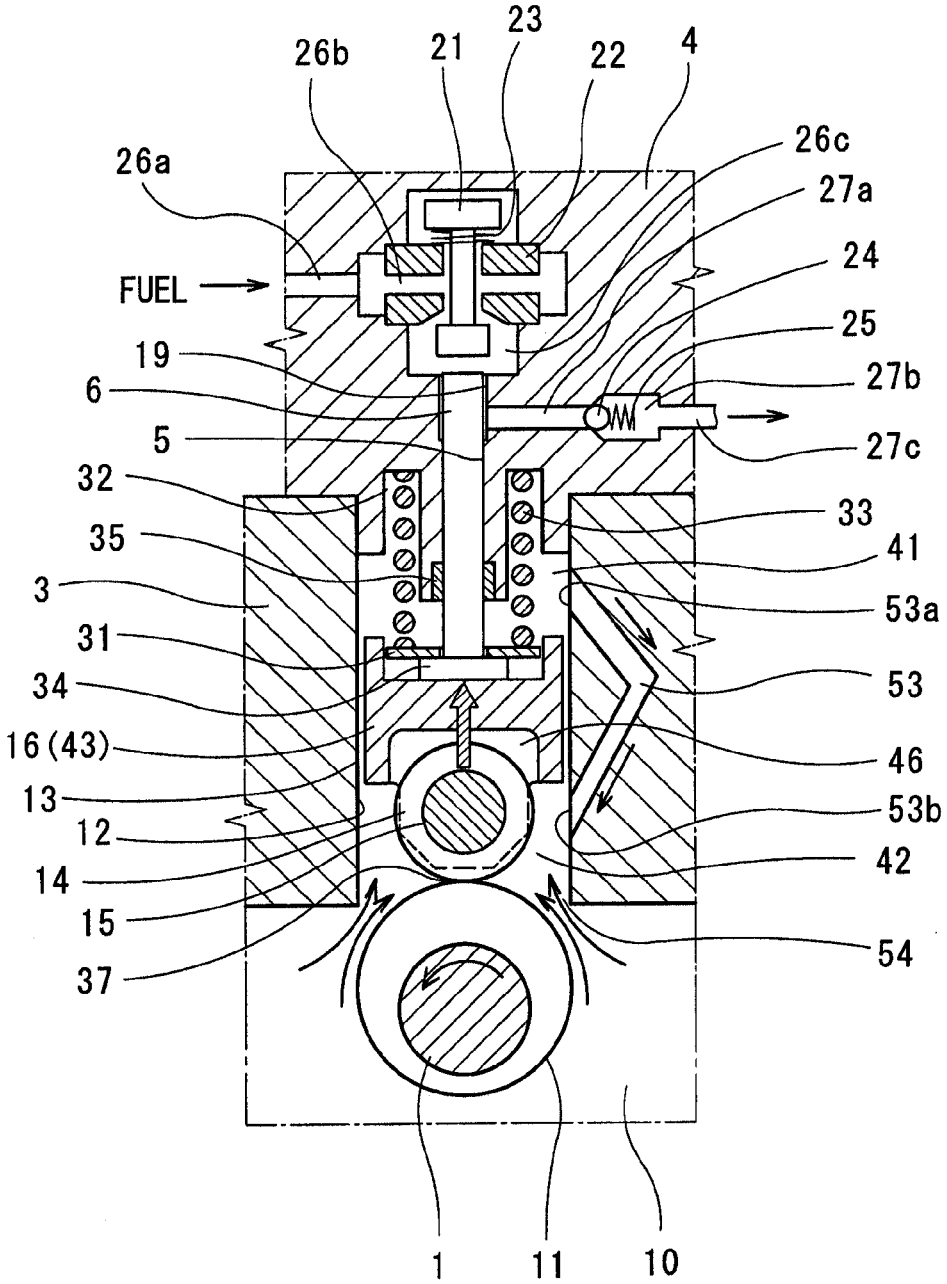
FIG. 3 is a cross-sectional view showing the schematic structure of the engine having the supply pump according to the first embodiment.

FIGS. 1 to 3 show a tappet lubricating device of a first embodiment, in which the principle of the present disclosure is applied.

The lubricating device for an internal combustion engine of the present embodiment is a system that circulates and supplies engine oil (lubricant oil: hereinafter referred to as oil) to respective corresponding parts (lubricating parts, such as sliding parts and bearing parts) of an internal combustion engine (a vehicle drive engine: hereinafter referred to as an engine), such as a diesel engine, installed in an engine room of a vehicle, such an automobile.

This system includes an oil pump (not shown), which is installed to a cylinder block of the engine, and the tappet lubricating device, which circulates and supplies the engine oil (the lubricating oil: hereinafter referred to as the oil) outputted from the oil pump to respective lubricating portions of the plunger drive mechanism of the supply pump.

The oil pump is rotated synchronously with rotation of a crankshaft (output shaft) of the engine to forcefully circulate the oil in an oil circulation path (including respective lubricating portions of the engine and the supply pump). This oil pump draws the oil, which is stored in an oil storage chamber of an oil pan and then pressurizes and discharges the drawn oil to the oil circulation path.

Details of the tappet lubricating device will be described later.

The engine includes the cylinder block, in which a plurality of cylinders is formed, and a cylinder head, which is joined to an upper portion of the cylinder block. The engine also includes a crankcase, which is formed at a lower portion of the cylinder block, and the oil pan, which is formed integrally with the lower portion of the crankcase.

A fuel supply device, which supplies the fuel to the engine, is formed by a common rail type fuel injection system known as a fuel injection system of, for example, the diesel engine.

This common rail type fuel injection system includes a fuel filter, a low pressure fuel pump (hereinafter referred to as a feed pump), the supply pump, a common rail, and a plurality of fuel injection valves (injectors).

The supply pump is a high pressure pump that pressurizes and discharges the fuel drawn into a fuel pressurizing chamber (described later) through reciprocation of a plunger (described later) in a cylinder configured into a cylindrical form.

The supply pump 100 includes a camshaft 1, which is rotated in a predetermined direction synchronously with rotation of the crankshaft of the engine and, a housing 3, which rotatably supports the camshaft 1.

The supply pump 100 includes a cylinder body 4, which is secured to an upper portion of the housing 3 with fixing elements, such as bolts, and a plunger 6, which is reciprocated in a cylinder barrel 5 of the cylinder body 4.

The camshaft 1 is rotated by the crankshaft of the engine. The camshaft 1 is rotatably supported by the housing 3 through two metal bushes 9. A cam 11, which has at least one cam mountain (cam lobe), is integrally installed to an outer peripheral surface of the camshaft 1. The cam 11 is rotatably received in a cam/shaft receiving chamber 10 of the housing 3 along with the camshaft 1.

The camshaft 1 is coupled to the crankshaft in such a manner that the camshaft 1 makes one rotation when the crankshaft makes two rotations.

A tappet guide 12, which is configured into a cylindrical form, is formed in the inside of the housing 3.

Here, in a case where the reciprocating direction of the plunger 6 is assumed to be a top-to-bottom direction, a tappet receiving chamber 13, which receives the plunger drive mechanism 50 for reciprocating the plunger 6 in the top-to-bottom direction, is formed. The oil, which lubricates the respective lubricating portions of the plunger drive mechanism 50, is temporarily retained in the tappet receiving chamber 13.

The housing 3 is formed integrally with the cylinder head or the cylinder block of the engine. Specifically, the housing 3 is integrally formed in the cylinder head or the cylinder block of the engine. Alternatively, the housing 3 may be fixed to a pump receiving portion of the cylinder head or the cylinder block of the engine with fixture elements, such as bolts.

A slide surface 12*b*, along which an outer peripheral surface 16*a* of a tappet 16 of the plunger drive mechanism 50 reciprocates and slides, is formed in an inner peripheral surface (also referred to as an inner peripheral wall surface) 12*a* of the tappet guide 12 of the housing 3.

The plunger drive mechanism 50 includes a tappet roller 14, a roller pin 15, a tappet (a tappet body) 16, and a roller bush 17. The tappet roller 14 contacts an outer peripheral surface (cam profile) of the cam 11 of the camshaft 1. The roller pin 15 rotatably supports the tappet roller 14. The tappet 16 is connected to the tappet roller 14 in an integrally movable manner through the roller pin 15. The roller bush 17 is placed between the tappet roller 14 and the roller pin 15.

Details of the plunger drive mechanism 50 will be described later.

The cylinder barrel 5, which is configured into a cylindrical tubular form, is formed in the cylinder body 4 such that the slide surface of the plunger 6 is reciprocatable and is slidable along the cylinder barrel 5. A fuel pressurizing chamber 19 is formed at one axial end of the cylinder barrel 5 (a radially outer side of the camshaft 1).

A suction valve receiving chamber, which is communicated with an outlet side of the feed pump, is formed in the cylinder body 4. A fuel suction valve, which opens and closes a fuel suction flow passage (described later) located on an upstream side of the fuel pressurizing chamber 19, is received in an inside of the suction valve receiving chamber. The fuel suction valve includes a spool valve 21, which is placed on one axial side (the upper side in the drawing) of the cylinder barrel 5 of the cylinder body 4.

The fuel suction valve includes a valve body 22, which reciprocatably and slidably supports the spool valve 21, and a return spring 23, which urges the spool valve 21 in a valve closing direction.

A receiving recess (receiving hole), which opens toward an outside, is formed in the cylinder body 4. A fuel discharge valve having a check valve structure is received in a deep side (pressurizing chamber side) of this receiving recess. The fuel discharge valve includes a valve (a valve element) 24, which opens and closes a fuel discharge flow passage (described later), and a return spring 25, which urges the valve 24 in the valve closing direction.

A fuel suction flow passage includes a fuel suction flow passage 26*a*, a fuel suction hole 26*b*, and a valve receiving chamber (a valve element receiving chamber) 26*c*. The fuel suction flow passage 26*a* is communicated with an inlet port (suction port) that receives the fuel from the feed pump. The fuel suction hole 26*b* is communicated with the fuel suction flow passage 26*a*. The valve receiving chamber 26*c* communicates between the fuel suction hole 26*b* and the fuel pressurizing chamber 19.

The fuel discharge flow passage includes a fuel discharge hole 27*a*, a discharge valve receiving chamber 27*b*, a fuel discharge hole 27*c*, and an outlet port (discharge port). The fuel discharge hole 27*a* is communicated with the fuel pressurizing chamber 19. The discharge valve receiving chamber 27*b* is communicated with the fuel discharge hole 27*a*. The fuel discharge hole 27*c* is communicated with the discharge valve receiving chamber 27*b*. The outlet port (discharge port) opens toward the outside.

The supply pump 100 includes the plunger drive mechanism 50, which is placed between the cam 11 of the camshaft 1 and the plunger 6.

A spring seat 31 is installed to an outer peripheral surface of a lower end part of the plunger 6 shown in the drawing. Furthermore, a spring receiving portion 32, which is configured into a tubular form, is formed at a lower end part of the cylinder body 4 shown in the drawing. A plunger spring 33, which urges the plunger drive mechanism 50 against the outer peripheral surface (profile) of the cam 11, is installed between an upper end surface of the spring seat 31 and a deep side surface of the spring receiving portion 32.

A tappet contact portion 34, which is configured into a flange form, is formed at a lower end part of the plunger 6 shown in the drawing.

Furthermore, the supply pump 100 includes a seal member 35, which is configured into a tubular form and liquid-tightly seals a gap (clearance) between an outer peripheral surface of an intermediate part of the plunger 6 and an inner peripheral surface of the lower end part of the cylinder barrel 5 of the cylinder body 4. The seal member 35 limits outflow of the fuel from the fuel pressurizing chamber 19 to the tappet receiving chamber 13 through the clearance. The outflow of the fuel from the fuel pressurizing chamber 19 to the tappet receiving chamber 13 would result in mixing of the fuel into the oil.

The plunger drive mechanism 50 includes the tappet roller 14, the roller pin 15, and the tappet 16.

The tappet roller 14 is rotatably supported by an outer peripheral surface of the roller pin 15. The tappet roller 14 reciprocates the plunger 6 in the reciprocating direction along the contour of the cam mountain of the cam 11 and directly contacts the cam mountain of the cam 11.

The roller pin 15 is installed to the tappet roller 14 such that the roller pin 15 extends through the tappet roller 14 in the axial direction of the tappet roller 14. The roller pin 15 includes projecting shaft portions 36, which project outward from two end surfaces, respectively, of the tappet roller 14 in the axial direction of the rotational axis of the tappet roller 14.

When the tappet roller 14 is rotated about the roller pin 15 in a circumferential direction, seizing may possibly occur between the tappet roller 14 and the roller pin 15. Because of this reason, the roller bush 17, which is configured into a cylindrical tubular form, is placed between an inner peripheral surface of the tappet roller 14 and an outer peripheral surface of the roller pin 15.

Furthermore, a roller contact surface 37, which slidably contacts the outer peripheral surface of the tappet roller 14, is formed in the outer peripheral surface of the cam 11 of the camshaft 1.

The tappet 16 converts the rotation of the cam 11 into the reciprocation of the plunger 6 in the top-to-bottom direction to reciprocate the plunger 6. The tappet 16 is reciprocatably and slidably supported by the tappet guide 12 of the housing 3. The tappet 16 is connected to the tappet roller 14 in an integrally movable manner through the roller pin 15. Furthermore, the tappet 16 is constructed to reciprocate integrally with the plunger 6, the tappet roller 14, and the roller pin 15.

The tappet 16 includes a partition wall (also referred to as a partition portion) 43 that partitions the tappet receiving chamber 13 of the housing 3 into a tappet upper side chamber 41 and a tappet lower side chamber 42, which are located on an upper side and a lower side, respectively, of the partition wall 43 in an axial direction of an axis of the plunger 6. The tappet upper side chamber 41 receives the tappet contact portion 34 of the plunger 6, the spring seat 31, and the plunger spring 33. The tappet lower side chamber 42 receives the tappet roller 14, a support wall 44 of the tappet 16, the roller pin 15, the roller contact surface 37 of the cam 11.

The tappet upper side chamber 41 is a second volume variable space (plunger side chamber) that is formed by a tappet side surface (a lower surface in the drawing) 4*a* of the cylinder body 4, a tappet side surface (a lower end surface in the drawing) 35*a* of the seal member 35, the inner peripheral surface 12*a* of the tappet guide 12, and a plunger side surface (an upper end surface in the drawing) 43*a* of the partition wall 43 of the tappet 16. That is, the tappet upper side chamber 41 is surrounded by the tappet side surface 4*a* of the cylinder body 4, the tappet side surface 35*a* of the seal member 35, the inner peripheral surface 12*a* of the tappet guide 12, and the plunger side surface 43*a* of the partition wall 43 of the tappet 16.

The tappet upper side chamber 41 is placed on a tappet/plunger upwardly moving side of the partition wall 43 of the tappet 16, i.e., on the plunger 6 side of the partition wall 43 of the tappet 16. The tappet upper side chamber 41 is communicated with the tappet lower side chamber 42 through a minute clearance formed between the inner peripheral surface 12*a* of the tappet guide 12 and the outer peripheral surface 16*a* of the tappet 16. A volume of the tappet upper side chamber 41 is reduced at the time of upwardly moving the tappet 16 and the plunger 6. The volume of the tappet upper side chamber 41 is increased at the time of downwardly moving the tappet 16 and the plunger 6.

The tappet lower side chamber 42 is a first volume variable space (cam side chamber), which is defined by the outer peripheral surface (the roller contact surface 37) of the cam 11, the inner peripheral surface 12*a* of the tappet guide 12, and the cam side surface (the lower end surface in the drawing) 43*b* of the partition wall 43 of the tappet 16. That is, the tappet lower side chamber 42 is surrounded by the roller contact surface 37 of the cam 11, the inner peripheral surface 12*a* of the tappet guide 12, and the cam side surface 43*b* of the partition wall 43.

The tappet lower side chamber 42 is located on the tappet/plunger downwardly moving side of the partition wall 43 of the tappet 16, i.e., on the cam 11 side of the partition wall 43 of the tappet 16. The tappet lower side chamber 42 is communicated with the cam/shaft receiving chamber 10 through a flow restriction passage (discussed later). The tappet lower side chamber 42 is communicated with the oil storage chamber of the oil pan through the flow restriction passage and the cam/shaft receiving chamber 10. A volume of the tappet lower side chamber 42 is increased at the time of upwardly moving the tappet 16 and the plunger 6. The volume of the tappet lower side chamber 42 is decreased at the time of downwardly moving the tappet 16 and the plunger 6.

The tappet contact portion 34 of the plunger 6 directly contacts the upper surface, i.e., the plunger side surface 43*a* of the partition wall 43.

The tappet 16 includes a cylindrical peripheral wall, which axially projects from an outer peripheral portion of the partition wall 43 toward the plunger side (the upper side in the drawing).

The tappet 16 includes the support wall 44, which is configured into a tubular form and axially projects from the outer peripheral portion of the partition wall 43 toward the cam 11 side (the lower side in the drawing). Insertion holes 45, into which the projecting shaft portions 36 of the roller pin 15 are rotatably inserted, are formed in the support wall 44. A roller receiving chamber 46, which rotatably supports the tappet roller 14, is formed in the inside of the support wall 44. The roller receiving chamber 46 is included in the tappet lower side chamber 42.

The projecting shaft portions 36 of the roller pin 15 may be fixed to the support wall 44. Furthermore, the space below the support wall 44 of the tappet 16 shown in the drawing may be formed as the tappet lower side chamber 42. In such a case, the roller receiving chamber 46 is not included in the tappet lower side chamber 42.

Next, details of the tappet lubricating device of the present embodiment will be briefly described with reference to FIGS. 1 to 3.

The tappet lubricating device is the system that circulates and supplies the oil to the respective lubricating portions of the plunger drive mechanism 50 of the supply pump 100 and includes oil supply passages 51, 52, a communication hole 53 and a flow restriction passage 54.

Here, the lubricating portions of the plunger drive mechanism 50 may include, for example, a contact portion between the tappet contact portion 34 of the plunger 6 and the partition wall 43 of the tappet 16, a contact portion between the roller contact surface 37 of the cam 11 and the tappet roller 14, a slide portion (slide clearance) between the tappet guide 12 and the tappet 16, a slide portion (slide clearance) between the tappet roller 14 and the roller bush 17, and a slide portion between the roller pin 15 and the roller bush 17.

The oil supply passage 51 is formed in the housing 3. An upstream end of the oil supply passage 51 in a flow direction of the oil is connected to the outlet side of the oil pump. A downstream end of the oil supply passage 51 in the flow direction of the oil opens in the inner peripheral surface 12*a* of the tappet guide 12 of the housing 3, so that the oil supply passage 51 communicates between the outlet of the oil pump and the tappet receiving chamber 13. In this way, the oil is temporarily retained in the tappet receiving chamber 13.

The oil supply passage 52 is formed in the partition wall 43 of the tappet 16. An upstream end of the oil supply passage 52 in the flow direction of the oil is connected to a downstream end of the oil supply passage 51. A downstream end of the oil supply passage 51 in the flow direction of the oil opens in the wall surface of the roller receiving chamber 46 of the tappet 16 (i.e., the cam side surface 43*b* of the partition wall 43) and supplies the oil into the roller receiving chamber 46.

The communication hole 53, which communicates between the tappet upper side chamber 41 and the tappet lower side chamber 42, is formed in the housing 3. As shown in FIG. 2, this communication hole 53 includes an opening 53*a*, which opens in the wall surface of the tappet upper side chamber 41, and an opening 53*b,* which opens in the wall surface of the tappet lower side chamber 42. The openings 53*a,* 53*b* of the communication hole 53 open only in the inner peripheral surface 12*a* (the slide surface 12*b*) of the tappet guide 12 or a plane (the plane being extending along an extension line that extends from the slide surface 12*b* in the top-to-bottom direction) that is the same as a plane of the slide surface 12*b*. This plane may be a curved plane or a planar plane. For instance, this plane may be a curved plane in the case where the inner peripheral surface 12*a* is the curved surface. Alternatively, this plane may be a planar plane in a case where the inner peripheral surface 12*a* is a planar surface.

The communication hole 53 is bent into a V shape at an intermediate section between the upstream end and the downstream end in the flow direction of the oil.

The communication hole 53 is an oil pressure relief passage that has a passage cross-sectional area, which is larger than a passage cross-sectional area of the minute clearance (slide clearance) defined between the inner peripheral surface 12*a* of the tappet guide 12 and the outer peripheral surface 16*a* of the tappet 16.

The flow restriction passage 54 is an oil passage that communicates between the cam/shaft receiving chamber 10 of the housing 3 and the tappet lower side chamber 42 of the tappet guide 12. The flow restriction passage 54 is formed between the surface (the outer peripheral surface, two annular end surfaces) of the cam 11 of the camshaft 1 and the tappet guide 12. The cam 11 is received in the lower portion (the opening side) of the tappet lower side chamber 42 in the drawing, so that the passage cross sectional area of the lower portion (opening side) of the tappet lower side chamber 42 is reduced in the flow restriction passage 54. In this way, a flow resistance of the oil is increased at the time of passing through the flow restriction passage 54.

Furthermore, the oil, which is supplied from the tappet lower side chamber 42 to the roller contact surface 37 of the cam 11, is in a free-flowing state.

Operation of First Embodiment

Next, the operation of the supply pump 100 used in the common rail fuel injection system of the present embodiment will be briefly described with reference to FIGS. 1 to 3.

When the camshaft 1 of the supply pump 100 is rotated synchronously with rotation of the crankshaft of the engine, the tappet roller 14 is reciprocated in the top-to-bottom direction (making upward and downward movement, vertical movement) along the outer peripheral surface (the cam profile) of the cam 11.

This motion of the tappet roller 14 is transmitted to the tappet 16 through the roller pin 15, so that the tappet 16 is reciprocated in the top-to-bottom direction of the drawing (making upward and downward movement, vertical movement) in the tappet receiving chamber 13.

This motion of the tappet 16 is directly transmitted to the plunger 6, and thereby the plunger 6 is reciprocated in the top-to-bottom direction of the drawing (making upward and downward movement, vertical movement).

Then, when the plunger 6 at, for example, the top dead center is moved downward, a volume of the fuel pressurizing chamber 19 is increased, and thereby the fuel pressure in the fuel pressurizing chamber 19 is reduced. When the fuel pressure of the fuel suction flow passage becomes larger than a sum of the urging force of the return spring 25 of the fuel suction valve and the fuel pressure of the fuel pressurizing chamber 19, the spool valve 21 of the fuel suction valve is opened. That is, the spool valve 21 is lifted from a tapered seat surface of the valve body 22, so that the fuel suction flow passage is opened. In this way, the fuel, which is discharged from the feed pump, is drawn into the fuel pressurizing chamber 19 through the inlet port, the fuel suction flow passage 26*a,* the fuel suction hole 26*b,* and the valve receiving chamber 26*c* in this order.

Then, when the plunger 6 begins to move upward after reaching the bottom dead center, the volume of the fuel pressurizing chamber 19 is reduced, and the fuel pressure of the fuel pressurizing chamber 19 is increased. When the fuel pressure of the fuel suction flow passage becomes lower than the sum of the urging force of the return spring 25 of the fuel suction valve and the fuel pressure of the fuel pressurizing chamber 19, the spool valve 21 of the fuel suction valve is closed. That is, the spool valve 21 is seated against the tapered seat surface of the valve body 22 to close the fuel suction flow passage, and at the same time the fuel pressure of the fuel pressurizing chamber 19 is further increased. At this time, the fuel is pressurized and is compressed at the high pressure in the fuel pressurizing chamber 19.

When the fuel pressure of the fuel pressurizing chamber 19 is increased to a pressure that equal to or higher than the valve opening pressure of the fuel discharge valve, the valve 24 of the fuel discharge valve is opened. In this way, the high pressure fuel is pumped from the fuel pressurizing chamber 19 to the common rail through the fuel discharge flow passage (the fuel discharge hole 27*a,* the discharge valve receiving chamber 27*b,* the fuel discharge hole 27*c,* and the outlet port in this order).

When each of the injectors is valve opened at a given injection timing, the high pressure fuel, which is accumulated in the common rail, is injected into the corresponding one of the cylinders of the engine at predetermined timing.

Advantage of First Embodiment

Here, in the supply pump 100 used in the common fuel injection system, when the tappet roller 14 is moved onto the cam mountain of the cam 11 of the camshaft 1, the roller pin 15 and the tappet 16 are moved upward along with the plunger 6.

When the tappet 16 is moved upward, the volume of the tappet lower side chamber 42, which is located on the cam 11 side of the partition wall 43 of the tappet 16 in the tappet receiving chamber 13 is increased. In contrast, the volume of the tappet upper side chamber 41, which is located on the plunger 6 side of the partition wall 43 of the tappet 16, is reduced. In this way, the oil, which is retained in the tappet upper side chamber 41, is compressed, so that the pressure in the tappet upper side chamber 41 is increased.

In this way, wearing of the roller contact surface 37 of the cam 11 may possibly disadvantageously occur. Furthermore, a seal lip of the seal member 35, which liquid-tightly seals between the fuel pressurizing chamber 19 and the tappet upper side chamber 41 through a clearance, may possibly be lifted from the outer peripheral surface (the seal surface) of the plunger 6 due to an increase in the pressure of the tappet upper side chamber 41, and thereby the sealing performance for sealing between the fuel pressurizing chamber 19 and the tappet upper side chamber 41 may possibly be disadvantageously deteriorated.

In view of the above disadvantages, the supply pump 100 of the present embodiment includes the housing 3 that has the tappet receiving chamber 13, which receives the plunger drive mechanism 50, and the oil for lubricating the respective lubricating portions of the plunger drive mechanism 50 is temporarily retained in the tappet receiving chamber 13. The housing 3 is formed integrally with the cylinder head or the cylinder block of the engine.

The communication hole 53 is formed in the housing 3, which receives the supply pump 100. The communication hole 53 opens in the inner peripheral wall surface of the tappet guide 12 and guides the oil from the tappet upper side chamber 41 into the tappet lower side chamber 42 at the time of upwardly moving the tappet 16.

The communication hole 53 directly communicates between the tappet upper side chamber 41 and the tappet lower side chamber 42. The tappet upper side chamber 41 is formed by the tappet side surface 4*a* of the cylinder body 4, the tappet side surface 35*a* of the seal member 35, the inner peripheral surface 12*a* of the tappet guide 12, and the plunger side surface 43*a* of the partition wall 43 of the tappet 16. The tappet lower side chamber 42 is formed by the roller contact surface 37 of the cam 11, the inner peripheral surface 12*a* of the tappet guide 12, and the cam side surface 43*b* of the partition wall 43 of the tappet 16.

In this way, the amount of change in the volume of the tappet upper side chamber 41 and the amount of change in the volume of the tappet lower side chamber 42 become generally equal to each other, or the amount of change in the volume of the tappet lower side chamber 42 becomes larger than the amount of change in the volume of the tappet upper side chamber 41. Thereby, the oil suctioning effect at the tappet lower side chamber 42 becomes large. In this way, the volume of the tappet upper side chamber 41 is reduced in response to the upward movement of the tappet 16. In contrast, when the volume of the tappet lower side chamber 42 is increased, the oil, which is retained in the tappet upper side chamber 41, flows into the tappet lower side chamber 42 through the communication hole 53. Thus, the pressure increase in the tappet upper side chamber 41 can be sufficiently limited.

Thereby, wearing of the roller contact surface of the cam 11 may be limited. Furthermore, it is possible to limit the reduction in the sealing performance for sealing between the fuel pressurizing chamber 19 and the tappet upper side chamber 41.

Second Embodiment

Figure 4:
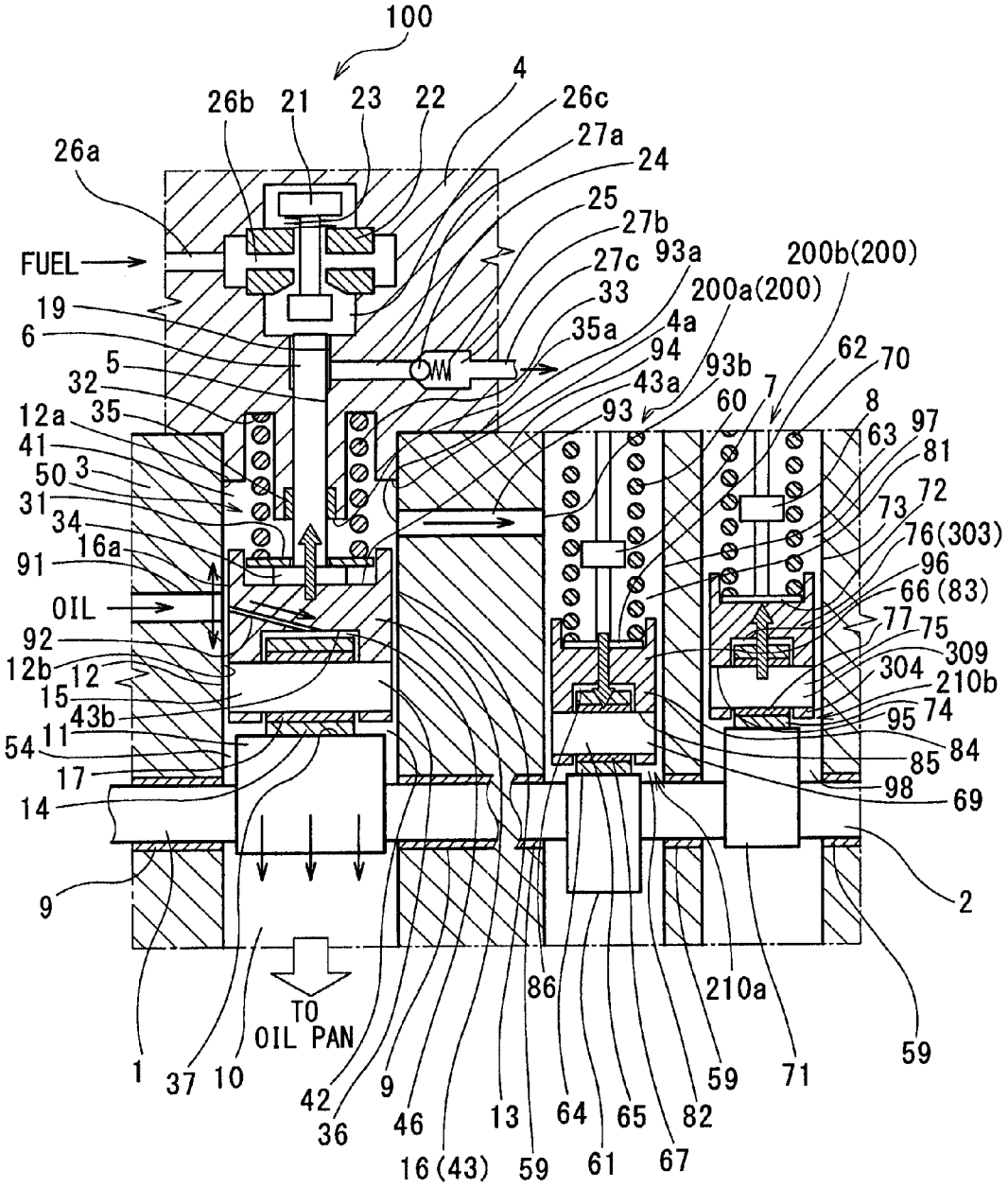
FIG. 4 is a cross-sectional view showing a schematic structure of an engine having a supply pump according to a second embodiment of the present disclosure.
Figure 5:
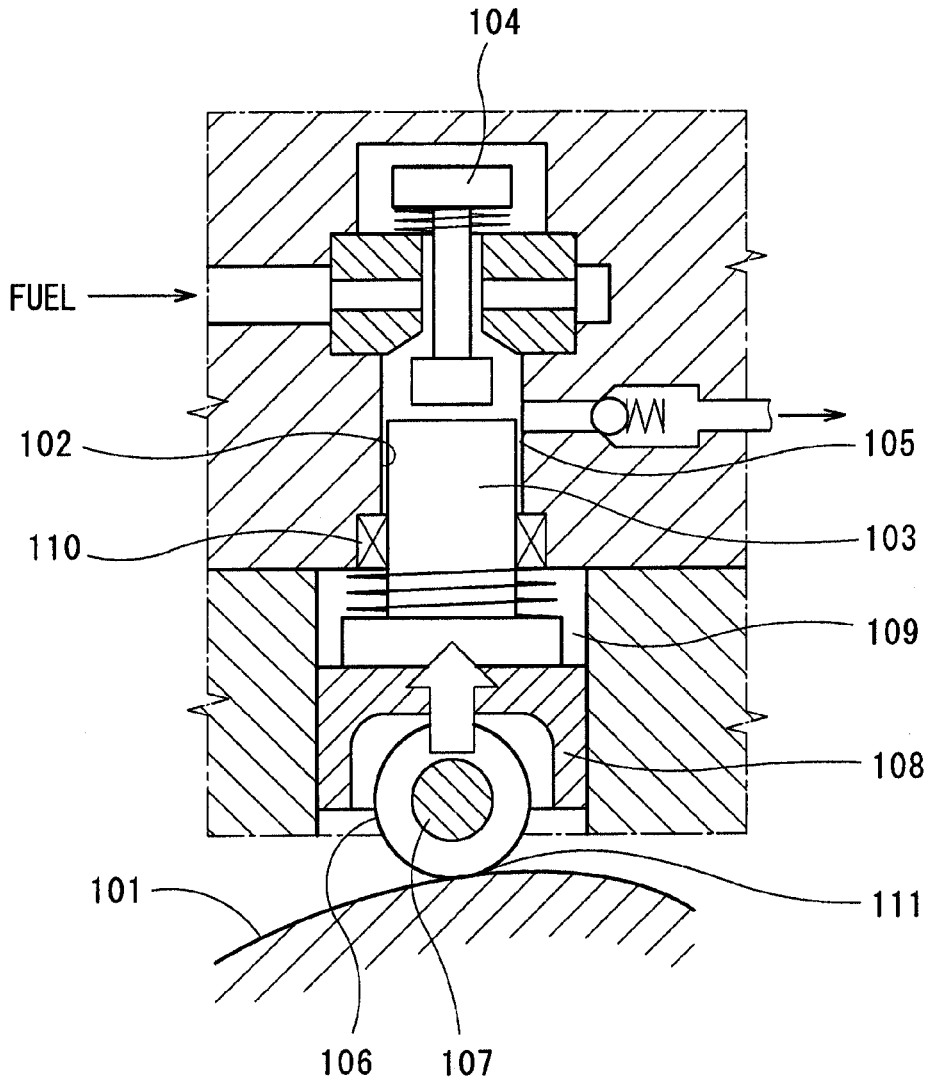
FIG. 5 PRIOR ART
FIG. 5 is a cross-sectional view showing a schematic structure of a supply pump of a prior art technique.

FIG. 4 shows a fuel injection system (second embodiment), in which the present disclosure is applied.

In the following discussion, the components, which are similar to those of the first embodiment, will be indicated by the same reference numerals and will not be described further for the sake of simplicity.

The lubricating device for the internal combustion engine according to the present embodiment includes: an oil pump (not shown) that draws and pumps engine oil (lubricating oil, hereinafter referred to as oil), which is stored in an oil storage chamber of an oil pan; a first tappet lubricating device that circulates and supplies the oil to the respective lubricating portions of the plunger drive mechanism 50 of the supply pump 100; a second tappet lubricating device that circulates and supplies the oil to respective lubricating portions of an intake valve drive mechanism (or simply referred to as a drive mechanism) 210*a* of an intake valve device 200*a;* and a third tappet lubricating device that circulates and supplies the oil to respective lubricating portions of an exhaust valve drive mechanism (or simply referred to as a drive mechanism) 210*b* of an exhaust valve device 200*b*. The intake valve device 200*a* and the exhaust valve device 200*b* cooperate together to form an intake and exhaust valve device 200.

Similar to the first embodiment, the supply pump 100 includes the camshaft 1, the housing 3, the cylinder body 4, the plunger 6, and the plunger drive mechanism 50. The plunger drive mechanism 50 includes the tappet roller 14, the roller pin 15, the tappet 16, and the roller bush 17.

The cam 11 of the camshaft 1 serves as a first cam of the present disclosure. The tappet roller 14 of the plunger drive mechanism 50 serves as a first roller of the present disclosure. The roller pin 15 serves as a first pin. The tappet 16 serves as a first tappet of the present disclosure.

Similar to the first embodiment, the tappet 16 includes the partition wall 43, which partitions the tappet receiving chamber 13 of the housing 3 into the tappet upper side chamber 41 and the tappet lower side chamber 42.

The partition wall 43 of the tappet 16 serves as a first partition portion of the present disclosure. The tappet lower side chamber 42 serves as a first cam side chamber of the present disclosure.

The intake and exhaust valve device 200 includes a camshaft 2 and the housing 3. The camshaft 2 is rotated in a predetermined direction synchronously with rotation of the crankshaft (the output shaft) of the engine. The housing 3 is common with the supply pump 100 and rotatably supports the camshaft 2. The intake and exhaust valve device 200 includes a stem (hereinafter referred to as an intake valve stem) 7 of an intake valve (air intake valve) and the intake valve drive mechanism 210*a*. The intake valve stem 7 opens and closes an opening (port opening) of an air intake port. The intake valve drive mechanism 210*a* reciprocates the intake valve stem 7 in the top-to-bottom direction. The intake and exhaust valve device 200 further includes a stem (hereinafter referred to as an exhaust valve stem) 8 of an exhaust valve and the exhaust valve drive mechanism 210*b*. The exhaust valve stem 8 opens and closes an opening (port opening) of an exhaust port. The exhaust valve drive mechanism 210*b* reciprocates the exhaust valve stem 8 in the top-to-bottom direction.

At least one air intake port, which is independently connected to a combustion chamber of corresponding one cylinder, is formed in the cylinder head of the engine. The intake valve, which opens and closes the opening of the intake port of the corresponding cylinder, is formed at a combustion chamber side end portion of the intake port of the cylinder.

At least one exhaust port, which is independently connected to the combustion chamber of the corresponding one cylinder, is formed in the cylinder head. The exhaust valve, which opens and closes the opening of the exhaust port of the corresponding cylinder, is formed at a combustion chamber side end portion of the exhaust port of the cylinder.

The cam/shaft receiving chamber 10 of the housing 3 is placed on the upper side of the oil storage chamber of the oil pan.

The camshaft 2 is rotated by the crankshaft of the engine. The camshaft 2 is rotatably supported by the housing 3 through three metal bushes 59. An intake cam 61, which has at least one cam mountain, and an exhaust cam 71, which has at least one cam mountain, are integrally assembled to the outer peripheral surface of the camshaft 2.

The camshaft 2 is coupled to the crankshaft of the engine in such a manner that the camshaft 2 makes one rotation when the crankshaft makes two rotations.

The intake cam 61 of the camshaft 2 serves as a second cam of the present disclosure.

An intake valve spring 60 is installed between the cylinder head of the engine and a flange (hereinafter referred to as a tappet contact portion) 62 of the intake valve stem 7. The intake valve spring 60 urges the intake valve drive mechanism 210*a* against the outer peripheral surface (the cam profile) of the intake cam 61.

An exhaust valve spring 70 is installed between the cylinder head and a flange (hereinafter referred to as a tappet contact portion) 72 of the exhaust valve stem 8. The exhaust valve spring 70 urges the exhaust valve drive mechanism 210*b* against the outer peripheral surface (the cam profile) of the exhaust cam 71.

Here, in a case where the reciprocating direction of the intake valve is defined as a top-to-bottom direction, a tappet receiving chamber 63, which receives the intake valve drive mechanism 210*a* that reciprocates the intake valve in the top-to-bottom direction, is formed in the inside of the housing 3. Furthermore, in a case where the reciprocating direction of the exhaust valve is defined as the top-to-bottom direction, a tappet receiving chamber 73, which receives the exhaust valve drive mechanism 210*b* that reciprocates the exhaust valve in the top-to-bottom direction, is formed in the inside of the housing 3.

The oil, which lubricates the respective lubricating portions of the intake valve drive mechanism 210*a* and the respective lubricating portions of the exhaust valve drive mechanism 210*b*, is temporarily retained in the tappet receiving chambers 63, 73.

The intake valve drive mechanism 210*a* includes a tappet roller 64, a roller pin 65, a tappet 66, and a roller bush 67. The tappet roller 64 contacts an outer peripheral surface (cam profile) of the intake cam 61 of the camshaft 2. The roller pin 65 rotatably supports the tappet roller 64. The tappet 66 is connected to the tappet roller 64 in an integrally movable manner through the roller pin 65. The roller bush 67 is placed between the tappet roller 64 and the roller pin 65.

The lubricating portions of the intake valve drive mechanism 210*a* may include, for example, a contact portion between the tappet contact portion 62 of the intake valve stem 7 and the partition portion (describe later) of the tappet 66, a contact portion between the intake cam 61 and the tappet roller 64, a slide portion (slide clearance) between the tappet roller 64 and the roller bush 67, and a slide portion between the roller pin 65 and the roller bush 67.

The exhaust valve drive mechanism 210*b* includes a tappet roller 74, a roller pin 75, a tappet 76, and a roller bush 77. The tappet roller 74 contacts an outer peripheral surface (cam profile) of the exhaust cam 71 of the camshaft 2. The roller pin 75 rotatably supports the tappet roller 74. The tappet 76 is connected to the tappet roller 74 in an integrally movable manner through the roller pin 75. The roller bush 77 is placed between the tappet roller 74 and the roller pin 75.

The lubricating portions of the exhaust valve drive mechanism 210*b* may include, for example, a contact portion between the tappet contact portion 72 of the exhaust valve stem 8 and the partition portion (describe later) of the tappet 76, a contact portion between the exhaust cam 71 and the tappet roller 74, a slide portion (slide clearance) between the tappet roller 74 and the roller bush 77, and a slide portion between the roller pin 75 and the roller bush 77.

The tappet roller 64 is rotatably supported by an outer peripheral surface of the roller pin 65. The tappet roller 64 reciprocates the intake valve stem 7 in the reciprocating direction along the contour of the cam mountain of the intake cam 61 and directly contacts the cam mountain of the intake cam 61.

The roller pin 65 is installed to the tappet roller 64 such that the roller pin 65 extends through the tappet roller 64 in the axial direction of the tappet roller 64. The roller pin 65 includes projecting shaft portions 69, which project outward from two end surfaces, respectively, of the tappet roller 64 in the axial direction of the rotational axis of the tappet roller 64.

The tappet 66 converts the rotation of the intake cam 61 into the reciprocation of the intake valve in the top-to-bottom direction of the intake valve. The tappet 66 is reciprocatably received in the tappet receiving chamber 63 of the housing 3. The tappet 66 is connected to the tappet roller 64 in an integrally movable manner through the roller pin 65. Furthermore, the tappet 66 is constructed to reciprocate integrally with the intake valve stem 7.

The tappet 66 includes a partition wall (a partition portion) 83 that partitions the tappet receiving chamber 63 of the housing 3 into a tappet upper side chamber 81 and a tappet lower side chamber 82.

The tappet upper side chamber 81 is a valve side chamber located on the intake valve stem 7 side of the partition wall 83 of the tappet 66.

The tappet lower side chamber 82 is a second cam side chamber that is located on the intake cam 61 side of the partition wall 83 of the tappet 66.

The tappet contact portion 62 of the intake valve stem 7 directly contacts an upper surface of the partition wall 83.

The tappet 66 includes a support wall 84, which is configured into a tubular form and extends from an outer peripheral portion of the partition wall 83 toward the lower side in the drawing. Insertion holes 85, into which the projecting shaft portions 69 of the roller pin 65 are rotatably inserted, are formed in the support wall 84. A roller receiving chamber 86, which rotatably supports the tappet roller 64, is formed in the inside of the support wall 84.

The projecting shaft portions 69 of the roller pin 65 may be fixed to the support wall 84.

The tappet contact portion 72 of the exhaust valve stem 8 directly contacts an upper surface of the tappet 76.

The tappet 76 includes a support wall 304, which is configured into the tubular form and extends from the outer peripheral portion of a partition wall (partition portion) 303 of the tappet 76 toward the lower side in the drawing. Insertion holes 95, into which projecting shaft portions 309 of the roller pin 75 are rotatably inserted, are formed in the support wall 304. A roller receiving chamber 96, which rotatably supports the tappet roller 74, is formed in the inside of the support wall 304. The partition wall 303 partitions the tappet receiving chamber 73 of the housing 3 into a tappet upper side chamber 97 and a tappet lower side chamber 98.

The projecting shaft portions 309 of the roller pin 75 may be fixed to the support wall 304.

Next, details of the first to third tappet lubricating devices will be briefly described with reference to FIG. 4.

The first tappet lubricating device is a system that circulates and supplies the oil to the respective lubricating portions of the plunger drive mechanism 50 of the supply pump 100. The second tappet lubricating device is a system that circulates and supplies the oil to the respective lubricating portions of the intake valve drive mechanism 210*a* of the intake and exhaust valve device 200. The third tappet lubricating device is a system that circulates and supplies the oil to the respective lubricating portions of the exhaust valve drive mechanism 210*b* of the intake and exhaust valve device 200.

The first and second tappet lubricating devices include oil supply passages 91, 92 and a communication hole 93.

The oil supply passage 91 is formed in the housing 3. Similar to the oil supply passage 51 of the first embodiment, an upstream end of the oil supply passage 91 in a flow direction of the oil is connected to the outlet side of the oil pump. A downstream end of the oil supply passage 91 in the flow direction of the oil opens in the inner peripheral surface 12*a* of the tappet guide 12 of the housing 3, and the oil supply passage 91 communicates between the outlet of the oil pump and the tappet receiving chamber 13. In this way, similar to the first embodiment, the oil is temporarily retained in the tappet receiving chamber 13.

The oil supply passage 92 is formed in the partition wall 43 of the tappet 16. An upstream end of the oil supply passage 92 in the flow direction of the oil is connected to the downstream end of the oil supply passage 91. A downstream end of the oil supply passage 92 in the flow direction of the oil opens in the wall surface of the roller receiving chamber 46 of the tappet 16 and supplies the oil to the slide portions among the tappet roller 14, the roller pin 15 and the roller bush 17.

A partition wall portion 94, which partitions between the tappet receiving chamber 13 and the tappet receiving chamber 63, is formed in the housing 3. The communication hole 93, which communicates between the tappet upper side chamber 41 and the tappet receiving chamber 63, is formed through the partition wall portion 94.

In a case where a phase difference between the cam 11 and the intake cam 61 is 180 degrees, the tappet upper side chamber 41 is formed in the housing 3 such that the tappet upper side chamber 41 is communicated with the tappet upper side chamber 81 of the tappet receiving chamber 63 through the communication hole 93. Furthermore, the communication hole 93 communicates between the tappet upper side chamber 41 and the tappet upper side chamber 81 along a straight line in a common plane. Alternatively, in a case where a vertical position of an upstream end of the communication hole 93, which opens in the inner peripheral surface 12*a* of the tappet guide 12, is different from a vertical position of a downstream end of the communication hole 93, which opens in the wall surface of the tappet upper side chamber 81, the communication hole 93 may communicate between the tappet upper side chamber 41 and the tappet upper side chamber 81 along a tilted line or along a curved line.

As discussed above, the engine, which has the supply pump 100 and the intake and exhaust valve device 200 of the present embodiment, includes the housing 3 where the oil is temporarily retained in the tappet receiving chamber 13, which receives the plunger drive mechanism 50 of the supply pump 100, and the tappet receiving chamber 63, which receives the intake valve drive mechanism 210*a* of the intake and exhaust valve device 200. Similar to the first embodiment, the housing 3 is formed integrally with the cylinder head or the cylinder block of the engine.

The housing 3, which receives the supply pump 100 and the intake and exhaust valve device 200, particularly, the partition wall portion 94 of the housing 3, which partitions between the tappet receiving chamber 13 and the tappet receiving chamber 63, is provided with the communication hole 93 that extends through the partition wall portion 94 in the left-to-right direction of the drawing, which is perpendicular to the top-to-bottom direction.

The communication hole 93 directly communicates between the tappet upper side chamber 41, which is located on the plunger 6 side of the partition wall 43 of the tappet 16, and the tappet upper side chamber 81, which is located on the intake valve stem 7 side of the partition wall 83 of the tappet 66. Furthermore, the communication hole 93 has an opening 93*a*, which opens in the wall surface of the tappet upper side chamber 41, and an opening 93*b*, which opens in the wall surface of the tappet upper side chamber 81. The opening 93*a* of the communication hole 93 opens in the inner peripheral surface 12*a* (the slide surface 12*b*) of the tappet guide 12 or the plane (the plane being extending along the extension line that extends from the slide surface 12*b* in the top-to-bottom direction) that is the same as the plane of the slide surface 12*b*.

Furthermore, the communication hole 93 is an oil pressure relief passage that opens in the inner peripheral wall surface of the tappet guide 12 and guides the oil from the tappet upper side chamber 41 into the tappet upper side chamber 81 at the time of upwardly moving the tappet 16.

In this way, the amount of change in the volume of the tappet upper side chamber 41 and the amount of change in the volume of the tappet upper side chamber 81 become generally equal to each other, or the amount of change in the volume of the tappet upper side chamber 81 becomes larger than the amount of change in the volume of the tappet upper side chamber 41. Thereby, the oil suctioning effect at the tappet upper side chamber 81 becomes large. In this way, the volume of the tappet upper side chamber 41 is reduced in response to the upward movement of the tappet 16. In contrast, when the volume of the tappet upper side chamber 81 is increased, the oil, which is retained in the tappet upper side chamber 41, flows into the tappet upper side chamber 81 through the communication hole 93 of the housing 3. Thus, the pressure increase in the tappet upper side chamber 41 can be sufficiently limited.

Thereby, wearing of the roller contact surface of the cam 11 may be limited. Furthermore, it is possible to limit the reduction in the sealing performance for sealing between the fuel pressurizing chamber 19 and the tappet upper side chamber 41.

(Modifications)

In the first and second embodiments, the drive mechanism, which reciprocates the plunger of the high pressure fuel pump, is applied in the plunger drive mechanism, which reciprocates the plunger of the supply pump used in the common rail fuel injection system. Alternatively, the drive mechanism, which reciprocates the plunger of the high pressure fuel pump, may be applied in a plunger drive mechanism, which reciprocates a plunger of a distributor fuel injection pump or an in-line fuel injection pump that is used in a fuel injection device having no common rail.

In the first and second embodiments, the present disclosure is applied to the supply pump 100 that has the fuel suction valve, which adjusts the quantity of the fuel drawn into the pressurizing chamber. Alternatively, the present disclosure may be applied to a supply pump that has an electromagnetic valve, which adjusts a quantity of fuel drawn into a pressurizing chamber.

An electromagnetic pump delivery control valve (PCV) of a normally closed type or an electromagnetic pump delivery control valve (PCV) of a normally open type may be used as the electromagnetic valve. In place of the PCV, an electromagnetic suction control valve (SCV) may be used.

In the second embodiment, there is discussed the example where the communication hole 93, which communicates between the tappet upper side chamber 41 of the plunger drive mechanism 50 and the tappet upper side chamber 81 of the intake valve drive mechanism 210*a*, is formed in the partition wall portion 94 of the housing 3. However, in a case where the phase difference between the cam 11 and the exhaust cam 71 is 180 degrees, the communication hole, which communicates between the tappet upper side chamber 41 of the plunger drive mechanism 50 and the tappet upper side chamber 97 (the exhaust valve stem 8 side chamber) of the exhaust valve drive mechanism 210*b*, may be formed in the partition wall portion of the housing 3.

In the second embodiment, the camshaft 1 and the camshaft 2 may be formed separately from each other and cooperate together to serve as a camshaft of the present disclosure. Alternatively, the camshaft 1 and the camshaft 2 may be formed integrally as a one-piece camshaft, which serves as the camshaft of the present disclosure. Also, the camshaft 1 or the one-piece camshaft described above may be provided separately from the supply pump 100.

In the second embodiment, the intake valve drive mechanism 210*a* and the exhaust valve drive mechanism 210*b* are driven by the common camshaft 2. Alternatively, the intake valve drive mechanism 210*a* and the exhaust valve drive mechanism 210*b* may be driven by separate camshafts (second and third camshafts), respectively.

The drive mechanism may be a drive mechanism of a type where the roller and the tappet directly slide relative to each other.

In the first and second embodiments, the feed pump is connected at the location that is on the upstream side of the intake port of the high pressure fuel pump in the flow direction of the fuel. Alternatively, a feed pump, in which the camshaft 1 is rotated in response to rotation of the crankshaft of the engine to pump the low pressure fuel from the fuel tank through the intake port of the high pressure fuel pump, may be received in the pump housing of the high pressure fuel pump.

Furthermore, the tappet 16 may be formed integrally with the plunger 6.

In the second embodiment, the communication hole 93 communicates between the tappet upper side chamber 41 of the tappet receiving chamber 13 and the tappet upper side chamber 81 of the tappet receiving chamber 63. Alternatively, the communication hole 93 may communicate between the tappet upper side chamber 41 of the tappet receiving chamber 13 and the tappet lower side chamber 82 of the tappet receiving chamber 63, if desired.

In the second embodiment, the plunger drive mechanism 50 serves as a first drive mechanism of the present disclosure, and the tappet receiving chamber 13 serves as a first receiving chamber of the present disclosure, which receives the first drive mechanism, i.e., the plunger drive mechanism 50. The cam 11, the tappet roller 14, the tappet 16, and the partition wall 43 serve as the first cam, the first roller, the first tappet, and the first partition portion, respectively, of the present disclosure. Furthermore, the intake valve device 200*a* is placed next to the supply pump (high pressure fuel pump) 100 having the plunger drive mechanism (first drive mechanism) 50, and the intake valve device 200*a* serves as a valve device of the present disclosure having the intake valve drive mechanism 210*a* as the second drive mechanism. The tappet receiving chamber 63 serves as a second receiving chamber, which receives the second drive mechanism, i.e., the intake valve drive mechanism 210*a*. The intake cam 61, the tappet roller 64, the tappet 66 and the partition wall 83 serve as the second cam, the second roller, the second tappet, and the second partition portion, respectively, of the present disclosure.

Alternatively, the exhaust valve device 200*b* may be placed next to the supply pump 100 to serve as the valve device of the present disclosure having the exhaust valve drive mechanism 210*b* as the second drive mechanism, and the intake valve device 200*a* may be placed on the other side of the exhaust valve device 200*b*, which is opposite from the plunger drive mechanism 50 in the axial direction of the camshaft 1, 2, to serve as a valve device having the third drive mechanism (the intake valve drive mechanism 210*a*). In such a case, if the phase difference between the cam 11 and the exhaust cam 71 is 180 degrees, the communication hole 93 may communicate between the tappet upper side chamber 41 of the tappet receiving chamber 13 to the tappet upper side chamber (serving as a valve side chamber) 97 of the tappet receiving chamber 73. Also, in such a case, the exhaust cam 71, the tappet roller 74 and the tappet 76 serve as the second cam, the second roller and the second tappet, respectively, of the present disclosure.

What is claimed is:

1. A lubricating device for an internal combustion engine, comprising:

a camshaft that includes a cam and is rotatable synchronously with an output shaft of the internal combustion engine;

a high pressure fuel pump that includes:

a plunger, which is reciprocatable along a contour of the cam; and a drive mechanism, which converts rotation of the cam into reciprocation of the plunger to reciprocate the plunger, wherein the high pressure fuel pump pressurizes the fuel drawn through the reciprocation of the plunger; and a housing that includes a receiving chamber, which receives the drive mechanism, wherein oil is retained in the receiving chamber, wherein:

the drive mechanism includes:

a roller, which contacts the cam; and a tappet, which is integrally movably connected to the roller and reciprocates integrally with the plunger;

the tappet includes a partition portion, which partitions the receiving chamber into a plunger side chamber and a cam side chamber;

the housing includes:

a guide, which is configured into a tubular form and guides the tappet in a reciprocating direction of the tappet; and a communication hole, which communicates between the plunger side chamber and the cam side chamber; and the cam side chamber is a first volume variable chamber that is formed by a roller contact surface of the cam, an inner peripheral surface of the guide, and a cam side surface of the tappet.

2. The lubricating device according to claim 1, wherein:

the housing includes a slide surface, along which an outer peripheral surface of the tappet is reciprocatable and is slidable;

the communication hole opens only in the slide surface or a plane that is the same as a plane of the slide surface.

3. The lubricating device according to claim 1, comprising:

a cylinder that reciprocatably and slidably supports the plunger; and a seal member, which is configured into a tubular form and seals a gap between an outer peripheral surface of the plunger and an inner peripheral surface of the cylinder, wherein:

the plunger side chamber is a second volume variable chamber that is formed by a tappet side surface of the cylinder, a tappet side surface of the seal member, the inner peripheral surface of the guide, and a plunger side surface of the tappet.

4. A lubricating device for an internal combustion engine, comprising:

a camshaft that includes a first cam and a second cam and is rotated synchronously with an output shaft of the internal combustion engine;

a high pressure fuel pump that includes:

a plunger, which is reciprocatable along a contour of the first cam; and a first drive mechanism, which converts rotation of the first cam into reciprocation of the plunger to reciprocate the plunger, wherein the high pressure fuel pump pressurizes the fuel drawn through the reciprocation of the plunger;

a valve device that includes:

a valve, which is reciprocatable along a contour of the second cam; and a second drive mechanism, which converts rotation of the second cam into reciprocation of the valve to reciprocate the valve, wherein the valve device opens and closes a port opening of the internal combustion engine; and a housing that includes:

a first receiving chamber, which receives the first drive mechanism; and a second receiving chamber, which receives the second drive mechanism, wherein:

oil is retained in the first receiving chamber and the second receiving chamber;

the first drive mechanism includes:

a first roller, which contacts the first cam; and a first tappet, which is integrally movably connected to the first roller and reciprocates integrally with the plunger;

the second drive mechanism includes:

a second roller, which contacts the second cam; and a second tappet, which is integrally movably connected to the second roller and reciprocates integrally with the valve;

the first tappet includes a first partition portion, which partitions the first receiving chamber into a plunger side chamber and a first cam side chamber;

the second tappet includes a second partition portion, which partitions the second receiving chamber into a valve side chamber and a second cam side chamber; and the housing includes a communication hole, which communicates the plunger side chamber to the valve side chamber or the second cam side chamber.

5. The lubricating device according to claim 4, wherein the housing includes a guide, which is configured into a tubular form and guides the first tappet in a reciprocating direction of the first tappet.

6. The lubricating device according to claim 4, wherein:

the housing includes a slide surface, along which an outer peripheral surface of the first tappet is reciprocatable and is slidable;

the communication hole opens in the slide surface or a plane that is the same as a plane of the slide surface.

7. The lubricating device according to claim 4, wherein:

in a case where a phase difference between the first cam and the second cam is 180 degrees, the plunger side chamber is communicated with the valve side chamber through the communication hole.

* * * * *